United States Patent [19]

McCormick et al.

[11] 4,403,793

[45] Sep. 13, 1983

[54] TRANSACTION SLIPS PACK

[75] Inventors: Joseph A. McCormick, Manhattan, Ill.; Lewis T. Hardin, Florissant, Mo.

[73] Assignee: General Credit Forms, Inc., Earth City, Mo.

[21] Appl. No.: 357,182

[22] Filed: Mar. 11, 1982

[51] Int. Cl.[3] ..... B42D 15/00; B41L 1/20

[52] U.S. Cl. ..... 283/105; 282/9 R; D19/5

[58] Field of Search ..... 283/103, 81, 104, 105; 282/9 R; D19/5, 9, 11

[56] References Cited

U.S. PATENT DOCUMENTS

| | | | |
|---|---|---|---|
| 2,121,203 | 6/1938 | Knoble | 283/105 X |
| 2,223,089 | 11/1940 | Beuglet | 283/105 X |
| 3,983,645 | 10/1976 | Rycroft | 283/105 X |
| 3,987,960 | 10/1976 | Gardiner | 283/81 X |
| 4,179,139 | 12/1979 | Savar et al. | 283/58 X |

*Primary Examiner*—Paul A. Bell
*Assistant Examiner*—John S. Brown
*Attorney, Agent, or Firm*—Merriam, Marshall & Bicknell

[57] ABSTRACT

An improved assembled pack or formset of credit card transaction slips with duplicating carbon slips having a series of perforations in the form of perforation strips aligned with the customer's credit card account number position on the transaction slips provided for the merchant, customer and credit card issuer. Simultaneous with deleaving or removing one of the transaction slips, the duplicating carbons are respectively split into two sections along the respective perforation strip, enabling the customer's account number to be accordingly split into two sections, and substantially preventing surreptitious reconstruction of the customer's account number from the used duplicating carbons.

5 Claims, 5 Drawing Figures

FIG. 1
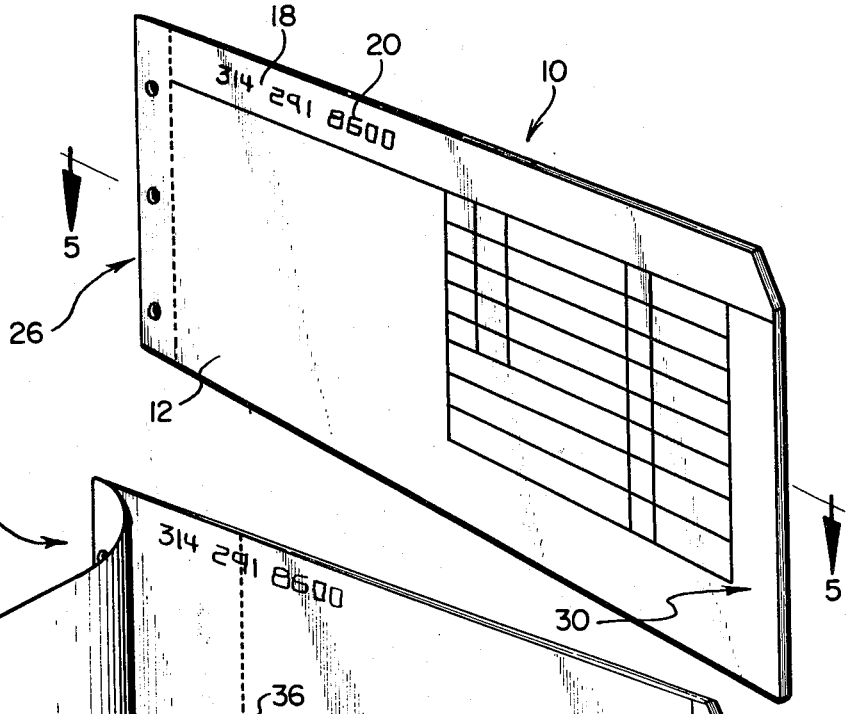
FIG. 2
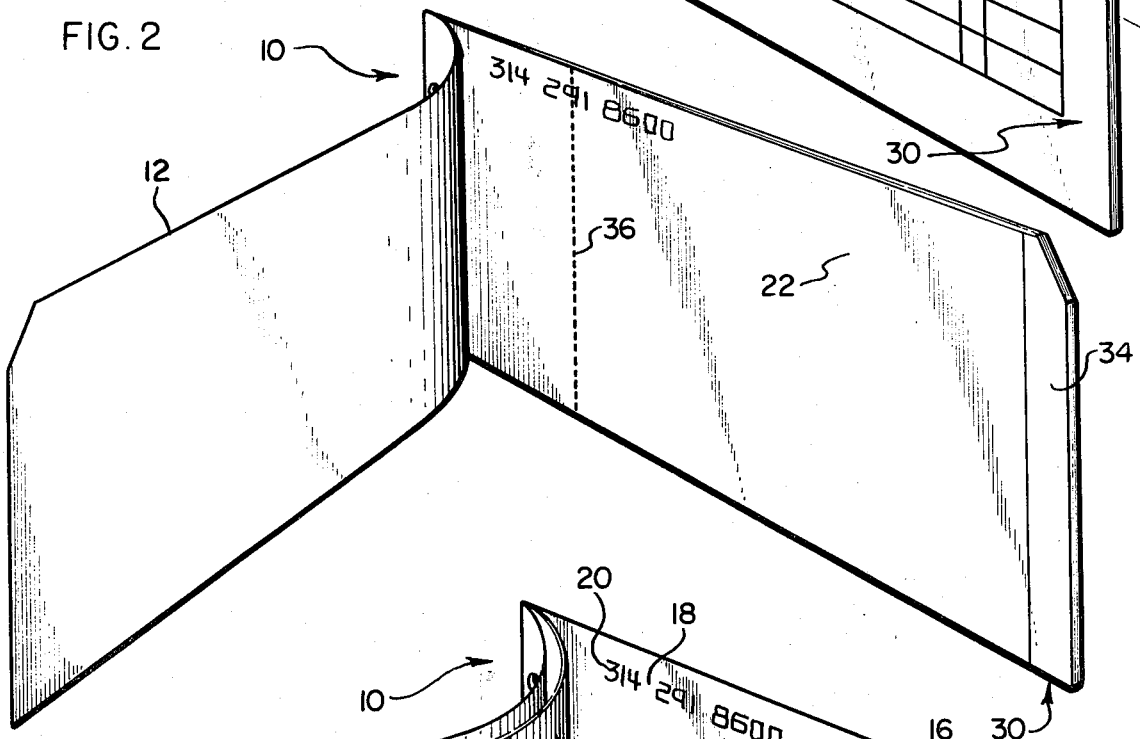
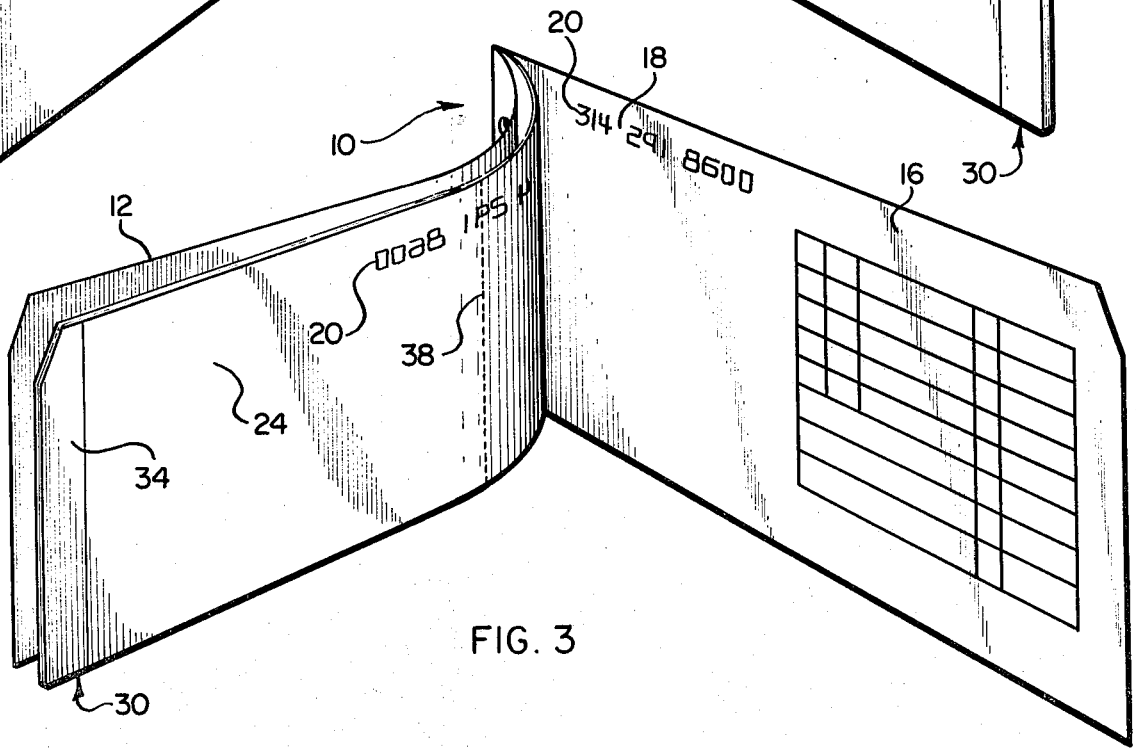
FIG. 3

TRANSACTION SLIPS PACK

This invention relates to credit card transaction slips which are arranged in an assembled pack or "formset" of paper and duplicating carbon components to receive printed information at defined positions relating to a commercial transaction, and in particular to an improved pack of credit card transaction slips for reducing the possibility of wrongfully obtaining the identification of a customer's credit card account number.

BACKGROUND OF THE INVENTION

In credit card transactions, which are in extensive use today, the merchant is provided with an assembled pack or "formset" of transaction slips or components for recording information relating to the merchant, the customer's credit card account number, etc. at defined positions on the slips. The pack may consist for example of a first paper transaction slip to be retained by the merchant, a second paper transaction slip to be given to the customer, and a third paper transaction slip which is forwarded to the bank or credit card issuer. One or more paper duplicating slips having a duplicating medium, commonly known as duplicating carbon slips, are including in the pack, with at least one duplicating carbon slip sandwiched between two transaction slips. Hereinafter, the terms "duplicating carbon slip" will be understood to refer to a duplicating strip having a duplicating medium and thus is synonymous with a "duplicating medium slip."

Thus, in normal use, a sales clerk, for instance, records the transaction information on the top transaction slip in the pack and may also at the same time imprint information onto all of the transaction slips as enabled by the intermediate duplicating carbon slips. The respective transaction slips are then deleaved or disjoined from the pack for presentment to the customer, etc. and the remaining duplicating carbon slips are placed into a container for later disposal.

It has now been found that in some instances, certain individuals have obtained the customer's identifying account number from a used duplicating carbon slip and have wrongfully utilized this information. Present estimates are that about 100 million dollars are lost nationwide by credit card issuers due to fraudulent transactions resulting from the wrongful use of credit card numbers obtained from used duplicating carbon slips.

Several means are currently utilized or have been proposed to reduce the possibility of obtaining the credit card numbers in this manner. As an example, carbonless packs or formsets are in current use which incorporate a duplicating medium coating on the reverse side of one of the paper transaction slips so that a separate duplicating carbon slip is not needed in the pack. However, carbonless packs are substantially more expensive than packs with duplicating carbon slips. Due to the significantly large number of credit card transactions, in many instances, merchants do not believe the extra expenses involved with carbonless packs are cost justified to reduce the subject problem. Another proposal has been to instruct the sales clerks to tear the used duplicating carbon slips into several pieces before placing them into the container. In most cases, such instructions are not followed because the sales clerks do not want to get smudges of the duplicating material on their hands or clothing. While shredding machines are available and economically justifiable in instances where there is only one sales clerk, to provide a shredding machine at a number of sales clerk positions would be cost prohibitive.

Accordingly, it is desired to provide a pack of credit card transaction slips with duplicating carbons wherein the possibility of obtaining a customer's account number from the used carbons is eliminated or at least substantially reduced.

SUMMARY OF THE INVENTION

An improved pack or formset of credit card transaction slips for recording information at defined positions relating to a customer's credit card account identification, a merchant's identification, etc. is provided. The improved pack includes at least two paper transaction slips with a duplicating medium slip or duplicating carbon slip between, with the paper transaction slips and the carbon slip being joined together at one end. The duplicating carbon slip includes a series of perforations in the form of a perforation strip extending across the face of the carbon slip and placed on the carbon at a position aligned with the customer identifying position on the paper transaction slips.

During normal use, the customer's account identifying number is recorded on the transaction slips and will therefore extend over or beyond and intersect the perforation strip on the carbon. Thus, when the sales clerk, for instance, moves the joined end of the pack away from the opposite free end of the carbon slip, the carbon slip will be split into two sections at the perforation strip, with each carbon section containing a portion of the characters identifying the customer's account number. Placing several of the split carbon sections into a container virtually makes it impossible for one to match the correct carbon sections together to obtain the complete customer's account number. A short stub section or portion without any carbon coating or duplicating medium coating may be provided at the free end of the carbon slip to eliminate any possibility of the user dirtying their hands with carbon smudge.

In a preferred embodiment of the invention, in connection with providing three paper transaction slips in an assembled pack joined at one end, a middle transaction slip is sandwiched between two duplicating carbon slips. Each of the duplicating carbon slips includes a perforation strip located on the respective carbon faces to eventually form two carbon sections, each having a portion of the customer's account number. The middle transaction slip is provided with a perforation strip at the joined end of the pack and a relatively stronger perforation at the free end of the pack. A narrow stub section joins the middle transaction slip and the two duplicating carbon slips at the other or free end of the pack.

After the transaction information is recorded on the pack, the pack is deleaved by grasping the joined end of the pack with one hand and the stub section at the free end of the pack with the other hand, and moving the two pack ends away from each other. This operation simultaneously deleaves the middle transaction slip from the joined end of the pack while also splitting the carbons into respective sections at the respective perforation strips so that each carbon section contains a portion of the customer's identification number. The middle transaction slip may then be deleaved from the stub section. Thereafter, upon disposal of the respective carbon sections into a container, if there has been more than one transaction, and certainly if there have been more than a few transactions, it will be extremely difficult and highly unlikely that one could match up the corresponding carbon sections of one transaction in an attempt to wrongfully obtain a customer's identification number.

BRIEF DESCRIPTION OF THE DRAWINGS

The features of this invention which are believed to be novel are set forth with particularity in the appended claims. The invention, together with its objects and advantages thereof, may be best understood by reference to the following description taken in conjunction with the accompanying drawings, in which like reference numerals identify like elements in the several figures and in which:

FIG. 1 is a perspective view of an improved pack of credit card transaction slips in accordance with the principles of the present invention;

FIG. 2 is a perspective view of the pack of credit card transaction slips shown in FIG. 1, with the upper-most paper transaction slip opened away from the pack, and illustrating a carbon provided with perforations in the form of a perforation strip extending through the account number;

FIG. 3 is a perspective view of the improved pack of FIG. 1, and illustrating the back side of another carbon slip containing a perforation strip extending through the account number;

DETAILED DESCRIPTION

Figure 4:
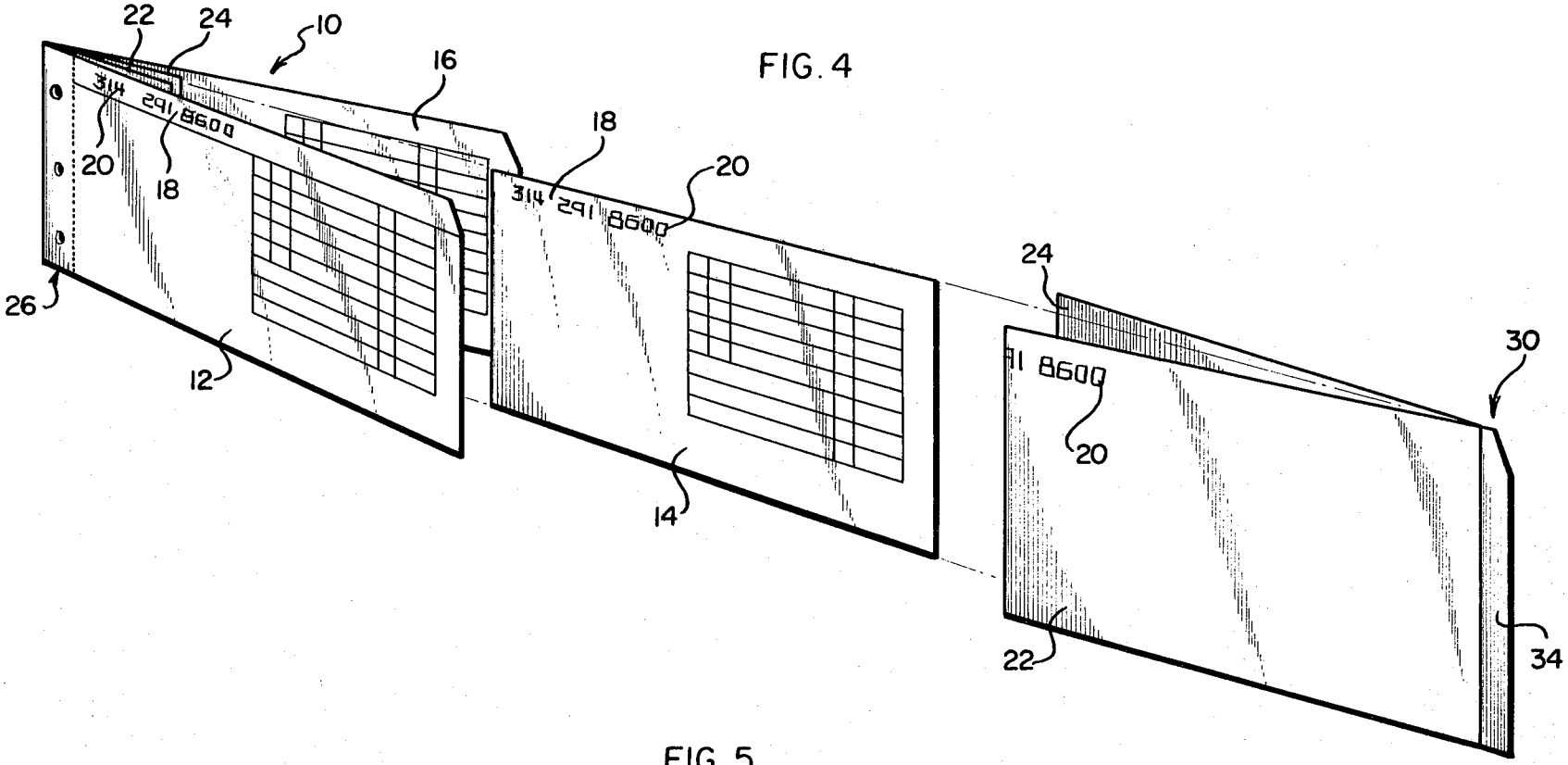
FIG. 4 is a perspective view of the improved pack of FIG. 1 illustrating the two carbon slips and a middle transaction slip which have been separated from the pack.

For purposes of illustration, the drawings and the present description are directed to a preferred embodiment of the invention in which an assembled pack 10 or formset of credit card transaction slips includes three paper transaction slips 12, 14 and 16, with a respective slip being provided for a merchant, a customer and the credit card issuer. It is to be understood that the preferred embodiment illustrated and to be described herein is provided merely to illustrate and describe the principles of the present invention. Thus, the same principles illustrated and described herein may be applied to situations in which only two paper transaction slips and only one duplicating carbon slip is utilized. Thus, no limitation in the appended claims is to be inferred from the present illustration and description.

As an example, upper-most paper transaction slip 12 may be a merchant copy, middle paper transaction slip 14 may be for the customer, and lower-most paper transaction slip 16 may be for the bank or credit card issuer. Each of the paper transaction slips includes a position 18 upon which the sales clerk may enter a series of characters 20 identifying a customer's account. Normally, the account information is taken from a credit card issued to the customer, and in most instances is recorded along with the customer's name in an imprinting operation using the credit card, an imprinter and pack 10.

Figure 5:
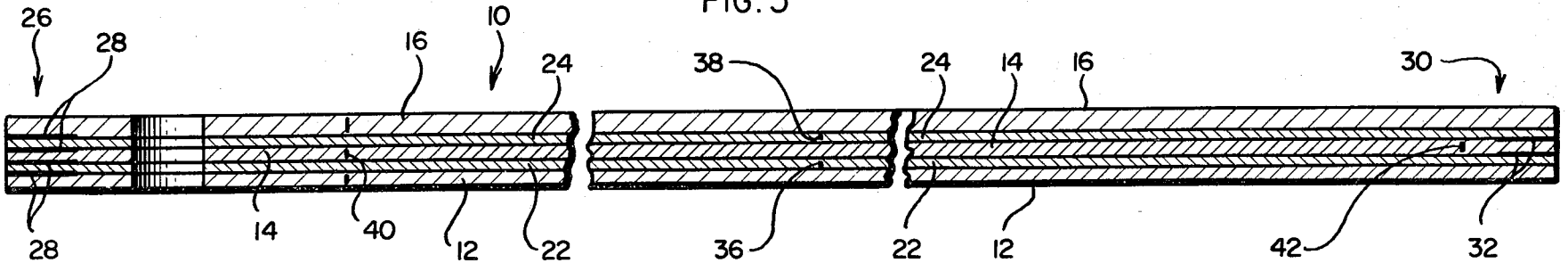
FIG. 5 is a fragmented sectional view taken along section lines 5—5 of FIG. 1.

As shown more clearly in the cross-sectional view of FIG. 5, middle transaction slip 14 is sandwiched between a pair of duplicating carbon slips 22, 24. Carbon slip 22 permits information placed on transaction slip 12 to be entered simultaneously also onto middle transaction slip 14, and carbon slip 24 permits this same information to simultaneously be placed onto lower-most transaction slip 16. Pack 10 is maintained together at one end 26 by means of a suitable adhesive 28 joining one end of each adjacent transaction slip and carbon slip to each other at pack end 26.

At pack end 30, only the free ends of middle transaction slip 14 and carbon slips 22, 24 are joined together such as by means of adhesive 32 so as to form a partial stub 34 at pack end 30. It is to be understood that the stub portion 34 preferably does not contain any duplicating material such that if placed between the sales clerk's fingers, the duplicating material will not smudge the fingers.

With specific reference to FIGS. 2 and 3, it can be seen that carbons 22, 24 are provided with a respective series of perforations in the form of perforation strips 36, 38 which extend between opposite edges of the carbons. Furthermore, it can be readily seen that perforation strips 36, 38 are located between pack end 26 and pack end 30 so as to extend directly in line with customer position 18 on the transaction slips. Therefore, when the sales clerk places characters 20 identifying a customer's account on the transaction slips, perforations 36, 38 intersect the customer's account number so that a respective portion of the customer's account number is located on either side of the carbon perforation strips. Middle transaction slip 14 includes a series of perforations 40 at pack end 26 and a series of perforations 42 at pack end 30, with perforations 42 somewhat stronger than perforations 40.

Accordingly, when the sales clerk deleaves the pack by holding pack end 26 in one hand and moving that end of the pack away from stub portion 34 which is held by the sales clerk's other hand, carbon slips 22 and 24 will be split along respective perforations 36, 38, splitting the customer's account number on either side of carbon slips 22, 24. Middle transaction slip 14 also will split along perforations 40 in the normal operation of moving stub portion 34 away from pack end 26 to deleave the middle transaction slip from the pack, and perforations 42 then may be split to remove transaction slip 14 from the two joined righthand sections of carbon slips 22, 24.

Upon disposal of the two joined righthand sections of carbon slips 22, 24, and thereafter removing transaction slips 12 and 16 along suitable perforations from pack 10 and disposing of the left hand split portions of carbon slips 22, 24, it will be highly improbable and virtually impossible for one to attempt to join together the split carbon portions to form the original correct customer's account number.

If desired, perforations 40 could be made stronger than perforations 42, so that transaction slip 14 will be split along perforations 42 simultaneously with splitting the carbon slips along perforation strips 36, 38. Alternatively, transaction slip 14 need not be joined at pack end 30 to the carbon slips, and may be slightly shorter in length than the carbon slips to enable the righthand sections of the carbon slips to be readily removed from the pack by splitting along perforation strips 36, 38.

The foregoing detailed description has been given for clearness of understanding only, and no unnecessary limitations should be understood therefrom, as modifications will be obvious to those skilled in the art.

What is claimed is:

1. In a pack of credit card transaction slips for recording information thereon at defined positions on each transaction slip, including a customer position for receiving characters identifying a customer's account, said pack including at least two of said transaction slips with a duplicating carbon slip or duplicating medium slip therebetween joined at one end to said transaction slips and having an opposite free end, the improvement comprising a series of perforations in the form of a perforation strip placed on said duplicating slip at a location intermediate the joined end and the free end and adapted to align with the customer position on the transaction slips, enabling said characters identifying a customer's account, when recorded on said duplicating slip, to be split into two carbon sections by disjoining said duplicating slip at said perforation strip upon moving said one end away from said free end.

2. A pack of credit card transaction slips according to claim 1, including a stub portion terminating the free end of said duplicating slip, said stub portion being free of any carbon or any duplicating medium.

3. In a pack of credit card transaction slips for recording information thereon at defined locations on each transaction slip, including a customer position for receiving characters identifying a customer's account, said pack including respective upper, lower, and middle transaction slips, with the middle transaction slip sandwiched between two duplicating carbon slips or two duplicating medium slips, all of said transaction slips and duplicating slips joined at one end of the pack, and at least the two duplicating slips joined at the other end of the pack, the improvement comprising a respective series of perforations in the form of respective perforation strips placed on respective duplicating slips at a location intermediate said one end of the pack and said other end of the pack and adapted to align with the customer position on said transaction slips, enabling said characters identifying a customer's account, when recorded on said duplicating slips, to be split into two respective sections by disjoining said duplicating slips at said perforation strips upon moving said one end of the pack away from the other end of the pack.

4. A pack of credit transaction slips according to claim 3, including a stub portion connected to said duplicating slips at the other end of the pack, said stub portion being free of any duplicating carbon or any duplicating medium.

5. A pack of credit card transaction slips according to claim 4, including a third series of perforations in the form of a third perforation strip placed in the middle transaction slip at said joined one end of the pack, and means for joining the middle transaction slip to said duplicating slips and said stub portion at the other end of the pack, enabling the middle transaction slip to be disjoined at said third perforation strip simultaneously with disjoining said duplicating slips and splitting said characters into two respective sections upon moving said one end of the pack away from said stub at the other end of the pack.

* * * * *